US009857069B2

(12) United States Patent
Kim

(10) Patent No.: US 9,857,069 B2
(45) Date of Patent: Jan. 2, 2018

(54) SPHERICAL LAMP WITH EASY HEAT DISSIPATION

(71) Applicant: KMW INC., Hwaseong, Gyeonggi-Do (KR)

(72) Inventor: Duk Yong Kim, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 62 days.

(21) Appl. No.: 14/192,501

(22) Filed: Feb. 27, 2014

(65) Prior Publication Data

US 2014/0177227 A1 Jun. 26, 2014

Related U.S. Application Data

(63) Continuation of application No. PCT/KR2012/006898, filed on Aug. 29, 2012.

(30) Foreign Application Priority Data

Aug. 29, 2011 (KR) ..... 20-2011-0007826 U

(51) Int. Cl.
*F21V 29/00* (2015.01)
*F21V 29/74* (2015.01)
(Continued)

(52) U.S. Cl.
CPC ..... *F21V 29/74* (2015.01); *F21S 8/063* (2013.01); *F21V 7/0008* (2013.01);
(Continued)

(58) Field of Classification Search
CPC ..... F21K 9/135
(Continued)

(56) References Cited

U.S. PATENT DOCUMENTS 5,749,646 A * 5/1998 Brittell ..... F21S 10/02 362/231
5,791,768 A * 8/1998 Splane, Jr. ..... F21V 7/0025 362/280
(Continued)

FOREIGN PATENT DOCUMENTS

CN 2163934 Y 5/1994
CN 200949790 Y 9/2007
(Continued)

OTHER PUBLICATIONS

European Search Report dated Apr. 13, 2015 for EP Application No. 12826713 (4 Pages).
(Continued)

*Primary Examiner* — Tsion Tumebo
(74) *Attorney, Agent, or Firm* — Mintz Levin Cohn Ferris Glovsky and Popeo, P.C.; Kongsik Kim; Colleen H. Witherell

(57) ABSTRACT

A spherical lamp with easy heat dissipation comprises: a lower substrate and an upper substrate, in each of which a plurality of LEDs are embedded; a substrate support portion having a plate shape, to which the lower and upper substrates are coupled and fixed to lower and upper portions thereof, respectively; lower and upper covers, which are fixed to lower and upper portions of the substrate support portion, respectively, and each of which has a semi-spherical shape; a support portion, which is connected to an upper center portion of the substrate support portion and is exposed to the exterior through a center portion of the upper cover; and a heat dissipation plate which is formed on a rear surface of the heat dissipation plate and provided with a coupling portion into which an end of the support portion is inserted and fixed.

11 Claims, 4 Drawing Sheets

(51) Int. Cl.

| | |
|---|---|
| ***F21S 8/06*** | (2006.01) |
| ***F21V 29/70*** | (2015.01) |
| ***F21V 7/00*** | (2006.01) |
| *F21Y 105/10* | (2016.01) |
| *F21Y 115/10* | (2016.01) |
| *F21Y 107/90* | (2016.01) |

(52) U.S. Cl.
CPC ..... *F21V 29/2212* (2013.01); *F21V 29/70* (2015.01); *F21Y 2105/10* (2016.08); *F21Y 2107/90* (2016.08); *F21Y 2115/10* (2016.08)

(58) Field of Classification Search
USPC ..... 362/294, 373
See application file for complete search history.

(56) References Cited

U.S. PATENT DOCUMENTS 6,234,649 B1 * 5/2001 Katougi ..... F21V 21/0824 362/227
6,758,578 B1 * 7/2004 Chou ..... F21V 17/06 362/391
6,874,914 B2 * 4/2005 Desanto ..... F21S 8/04 362/256
7,988,327 B1 * 8/2011 Knoble ..... F21S 8/036 362/227
8,109,654 B2 * 2/2012 Mo ..... F21S 8/04 362/249.01
8,227,962 B1 * 7/2012 Su ..... F21K 9/135 313/46
8,459,841 B2 * 6/2013 Huang ..... F21K 9/135 362/294
8,637,877 B2 * 1/2014 Negley ..... H01L 33/507 257/88
8,820,974 B2 * 9/2014 Chang ..... F21V 3/02 362/249.02
8,985,815 B2 * 3/2015 Chen ..... F21V 23/023 362/294
9,611,992 B2 * 4/2017 Scales ..... F21S 8/043
2009/0196045 A1 * 8/2009 Shuai ..... F21K 9/00 362/294
2009/0315442 A1 * 12/2009 Rooymans ..... F21V 29/004 313/46
2010/0301748 A1 * 12/2010 Sakai ..... H05B 33/08 315/50
2011/0075412 A1 * 3/2011 Wu ..... F21K 9/00 362/235
2011/0253358 A1 * 10/2011 Huang ..... F21K 9/135 165/185
2011/0286200 A1 * 11/2011 Iimura ..... F21K 9/135 362/84
2012/0056542 A1 * 3/2012 Hu ..... F21K 9/135 315/113
2012/0257395 A1 * 10/2012 Cotzias ..... F21V 17/06 362/351
2012/0275163 A1 * 11/2012 Chen ..... F21V 23/009 362/294
2012/0293057 A1 * 11/2012 Yamamoto ..... F21V 29/004 313/45
2012/0314420 A1 * 12/2012 Yamamoto ..... F21K 9/135 362/294
2013/0003346 A1 * 1/2013 Letoquin ..... F21K 9/135 362/84
2013/0107517 A1 * 5/2013 Shih ..... F21V 3/00 362/235

FOREIGN PATENT DOCUMENTS

| | | | |
|---|---|---|---|
| CN | 201106805 | Y | 8/2008 |
| CN | 201507821 | U | 6/2010 |
| CN | 102128370 | A | 7/2011 |
| CN | 102155664 | A | 8/2011 |
| EP | 2261553 | A1 | 12/2010 |
| JP | 2008218238 | A | 9/2008 |
| JP | 2010108858 | A | 5/2010 |
| JP | 2011-124207 | A | 6/2011 |
| KR | 10-2009-0017294 | A | 2/2009 |
| KR | 20090017294 | A | 2/2009 |
| KR | 10-0961726 | B1 | 6/2010 |
| KR | 10-2011-0008411 | A | 1/2011 |
| KR | 10-2011-0087012 | A | 8/2011 |
| WO | WO-2011053260 | A1 | 5/2011 |

OTHER PUBLICATIONS

CN Office Action dated Sep. 29, 2016 in corresponding Chinese Patent Application No. 201280051902.7.

* cited by examiner

SPHERICAL LAMP WITH EASY HEAT DISSIPATION

CROSS-REFERENCE TO RELATED APPLICATIONS

The present application is a continuation of International Application No. PCT/KR2012/006898 filed on Aug. 29, 2012, which claims priority to Korean Application No. 20-2011-0007826 filed on Aug. 29, 2011, which applications are incorporated herein by reference.

TECHNICAL FIELD

The present disclosure relates to a spherical lamp that facilitates heat dissipation, and more particularly, to a spherical lamp that facilitates heat dissipation in which a light source using LEDs is sealed by a spherical cover and the heat dissipation structure is improved.

BACKGROUND ART

Recently, technologies for indoor illumination using an LED, which consume low amounts of power and have a long lifespan, and which is environmentally friendly as compared to existing fluorescent lights or incandescent lamps, have been developed.

Basically, LEDs may emit lights at various levels of illumination and in different colors according to the setting of the LEDs. However, since it is complicated to set such LEDs for use indoors in a home or the like, most LEDs are fabricated as a single-color product with white or daylight color.

However, an indoor light using such a single-color LED is merely an illuminance-controlled light and cannot be expected to enhance the interior effect. Thus, such an indoor light does not suit the needs of a market.

In the prior art, a structure capable of emitting plural colors in an LED illumination lamp is disclosed in Korean Patent No. 0961726.

However, the invention disclosed in Korean Patent No. 0961726 (hereinafter, simply referred to as a "prior art 1") has a structure in which, since a PCB board installed within a spherical cover having a diameter larger than that of the opening provided in the spherical cover should be introduced into the spherical cover through the opening, a flexible PCB must be used and heat generated from LEDs cannot be efficiently dissipated.

Accordingly, there is a problem in that the lifespan of the LEDs is shortened due to the generated heat.

That is, when an illumination light uses a spherical cover on a light source, LEDs as the light source are accommodated in the spherical cover. Accordingly, there are problems in that, since heat is not readily dissipated, the lifespan of the LEDs is shortened by the generated heat, and the use of the illumination light is limited due to the heat generation.

SUMMARY

The present disclosure has been made in an effort to solve the problems as described above, and the present disclosure provides a spherical lamp that facilitates heat dissipation, in which multi-colored light is implemented by LEDs to be used for illumination, the LEDs are installed within a spherical cover, and a heat dissipation structure is improved such that the heat dissipation effect can be enhanced.

In addition, the present disclosure provides a spherical lamp configured to facilitate heat dissipation which enables beautiful illumination through various illumination effects.

In order to solve the problems described above, there is provided a spherical lamp which facilitates heat dissipation. The spherical lamp includes: lower and upper substrates, on each of which a plurality of LEDs are mounted; a plate-shaped substrate support unit having bottom and top surfaces, to which the lower and upper substrates are coupled, respectively; lower and upper semi-spherical covers fixed to the bottom and top surfaces of the substrate support unit, respectively; a support unit coupled to a central portion of the top surface of the substrate support unit and exposed to the outside through a central portion of the upper cover; and a heat dissipation plate having a coupling portion provided on a bottom surface thereof, an end of the support unit being inserted into and fixed to the coupling portion.

In a spherical lamp that facilitates heat dissipation according to the present disclosure, a side portion of a substrate unit, that supports a substrate including a plurality of LEDs, is exposed to the outside of a spherical cover so that the heat generated from the LEDs is transferred to the outside above the spherical cover using a support unit capable of transferring heat upward, and a heat dissipation plate is coupled to the support unit to dissipate the heat generated from the LEDs. As a result, the heat dissipation effect of the LEDs in the lamp using the spherical cover may be enhanced to prevent the shortening of the lifespan of the LEDs In addition, in the spherical lamp that facilitates heat dissipation according to the present disclosure, illuminations of different colors may be implemented using the substrate support unit as a border therebetween, and the light emitted to the top side of the substrate support unit may be reflected by the heat dissipation plate to provide beautiful illumination.

DETAILED DESCRIPTION

Hereinbelow, a spherical lamp facilitated in heat dissipation according to exemplary embodiments of the present disclosure will be described in detail with reference to accompanying drawings.

Figure 1:
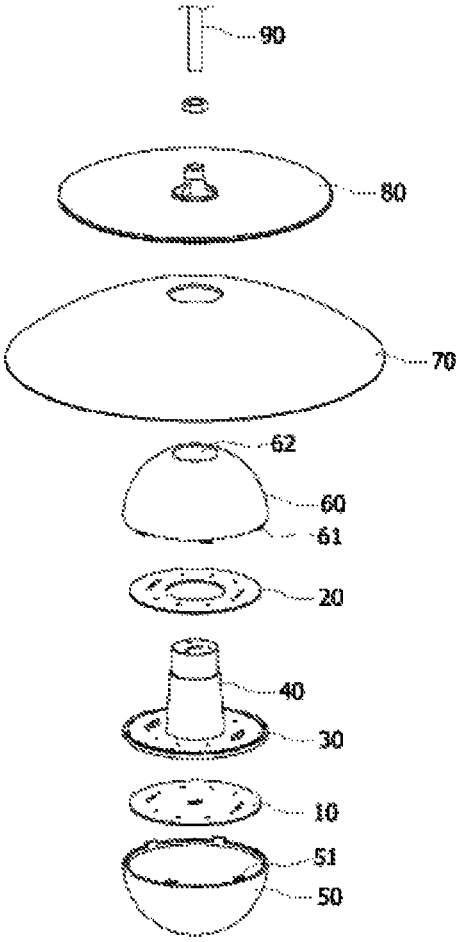
FIG. 1 is an exploded perspective view illustrating a spherical lamp that facilitates heat dissipation according to an exemplary embodiment of the present disclosure.
Figure 2:
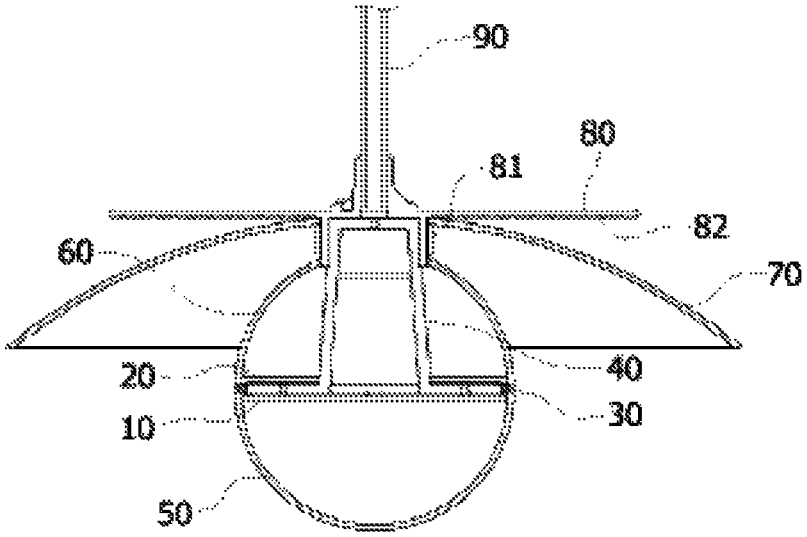
FIG. 2 is a cross-sectional view illustrating a configuration of the spherical lamp facilitated in heat dissipation according to the exemplary embodiment of the present invention in an assembled state.

FIG. 1 is an exploded perspective of a spherical lamp configured to facilitate heat dissipation according to an exemplary embodiment of the present disclosure, and FIG. 2 is a cross-sectional view illustrating a configuration of the spherical lamp of FIG. 2 in an assembled state.

Referring to FIGS. 1 and 2, a spherical lamp that facilitates heat dissipation according to an exemplary embodiment of the present disclosure includes: lower and upper substrates 10 and 20, each of which is provided with a plurality of LEDs (not illustrated); a disc-shaped substrate support unit 30 having a top surface and a bottom surface, to which the upper substrate 20 and the lower substrate 10 are coupled, respectively, the substrate support unit 30 including a plurality of coupling holes 31 and 32 formed vertically therethrough outside the lower substrate 10 and the upper substrate 20; a hollow support unit 40 coupled to a central portion of the substrate support unit 30 and extending upward; a semi-spherical lower cover 50 including, at an end thereof, one or more fastening portions 51 which are adapted to be fastened to the coupling holes 31 so that the lower cover 50 is coupled to the bottom surface of the substrate support unit 30 where the lower substrate 10 is coupled; a semi-spherical upper cover 60 including, at a central portion thereof, a through hole 62 through which the hollow support unit 40 passes, and, at an end thereof, one or more fastening portions 61 which are adapted to be fastened to the coupling holes 32 so that the upper cover 60 is coupled to the top surface of the substrate support unit 30 where the upper substrate 20 is coupled; a lampshade 70 fitted on the hollow support unit 40 extending from the top surface of the upper cover 60; and a disc-shaped heat dissipation plate 80 including, on a bottom surface thereof, a coupling portion 81 into which an end of the hollow support unit 40 extending above the lampshade 70 is inserted.

Reference numeral 90 which is not referred to above indicates a pendant which serves to fix the lamp to a ceiling.

Hereinafter, a configuration and a functional effect of the spherical lamp facilitating heat dissipation configured as described above according to an exemplary embodiment will be described in more detail.

First, the lower substrate 10 has a disc shape and is provided with plurality of LEDs on the bottom surface thereof in the installed state. The upper substrate 20 has a disc shape provided with a through hole at the central portion thereof and is mounted with a plurality of LEDs on the top surface thereof in the installed state.

Accordingly, the LEDs of the lower substrate 10 irradiate light downward and the LEDs of the upper substrate 20 irradiate light upward in which each of the LEDs may be configured to emit different colors.

The lower substrate 10 and the upper substrate 20 are fastened to the bottom surface and the top surface of the disc-shaped substrate support unit 30, respectively, using fastening means such as bolts. The diameter of the substrate support unit 30 is larger than the diameters of the lower substrate 10 and the upper substrate 20 and a plurality of coupling holes 31 and 32 are formed through the substrate support unit 30 on the peripheral edge of the substrate support unit 30.

The material of the substrate support unit 30 is a metal which is excellent in heat conductivity.

Accordingly, heat generated from the LEDs provided on each of the lower substrate 10 and the upper substrate 20 is transferred through the substrate support unit 30.

A cylindrical support unit 40 is coupled to the central portion of the top surface of the substrate support unit 30. The substrate support unit 30 and the support unit 40 may be configured separately or integrally.

The support part 40 is hollow to provide a space in which a wire that supplies power to the lower substrate 10 and the upper substrate 20 is provided. The wire is provided through the pendant 90.

The support unit 40 is also made of a metal which is excellent in heat conductivity and serves to dissipate the heat from the substrate support unit 30 to the outside.

In the coupled state as described above, a lower cover 50 is coupled to the bottom surface of the substrate support unit 30. The lower cover 50 has a semi-spherical shape and may be made of a resin material which is transparent or has a predetermined color.

Along a circular end of the lower cover 50, a plurality of fastening portions 51 are provided to protrude vertically at predetermined intervals. Each of the fastening portions 50 also protrudes laterally on the end of the vertically protruding portion so as to prevent the release of the fastening portions 50.

The fastening portions 51 are inserted into coupling holes 31 provided in the substrate support unit 30 so as to fix the lower cover 50.

In addition, the upper cover 60 has a semi-spherical shape and a through hole 62 is provided at the central portion of the upper cover so as to allow the support part 40 to pass therethrough. A plurality of fastening portions 61 are provided along the circular end of the upper cover 50. The upper cover 60 may also be made of a resin material which is transparent or has a predetermined color.

The fastening portions 61 are inserted into the coupling holes 32 on the top side of the substrate support unit 30 such that the support unit 40 is coupled to the top surface of the substrate support unit 30 in a state where a part of the support unit 40 is exposed.

At this time, the lower cover 50 and the upper cover 60 are respectively coupled to the bottom and top sides of the substrate support unit 30 to form a spherical light source. An illumination lamp using a sealed light source does not facilitate heat dissipation. However, a lateral portion of the substrate support unit 30 is exposed to the outside between the lower cover 50 and the upper cover 60 and dissipation occurs through this portion.

Figure 3:
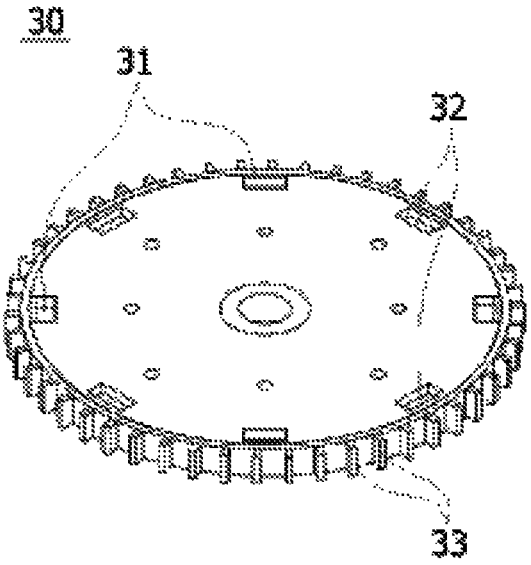
FIG. 3 is a perspective view illustrating a configuration of an exemplary embodiment of a substrate support unit applied to the present disclosure.

FIG. 3 is a view illustrating a configuration of an exemplary embodiment of the substrate support unit 30.

Referring to FIG. 3, the substrate support unit 30 is disc-shaped and provided with coupling holes 31 and 32 as described above. In order to facilitate the heat dissipation, a plurality of heat dissipation fins 33 may be provided on the side surface thereof.

When the circumferential surface of the substrate support unit 30, which is provided with the heat dissipation fins 33, is exposed to the outside between the lower cover 50 and the upper cover 60, the heat generated from the LEDs provided on the lower substrate 10 and the lower substrate 20 may be emitted more efficiently through heat exchange with the air.

In addition, a lampshade 70 is fitted on a portion of the supporting unit 40 protruding to the outside through the through hole 62 on the upper cover 60.

The lampshade 70 has a curvature to enclose the upper cover 60, and the bottom side of the lamp shade 70 facing the upper cover 60 may be a reflective surface or a transflective surface that partially reflects the light emitted from the LEDs of the upper substrate 20 and partially transmits the light.

The lampshade 70 may be made of a metal that facilitates heat dissipation to be used as a full reflective surface or made of a resin to be transflective with respect to light.

The lampshade 70 is fitted on the support unit 40 and a part of the support unit 40 is exposed to the top side of the lampshade 70. The exposed support unit 40 is inserted into and fixed to a coupling portion 81 of the heat dissipation plate 80. The coupling portion 81 is a recess that receives the support unit 40 and allows the heat of the LEDs, which is transferred thereto through the support unit 40, to be transferred to the heat dissipation plate 80 and dissipated.

At this time, in order to ensure that the heat may be efficiently transferred from the support unit 40 to the heat dissipation plate 80, the support part 40 and the coupling portion 81 should be snugly coupled to each other. When a gap exists between the support part 40 and the coupling portion 81, heat conductivity may be considerably reduced.

Figure 4:
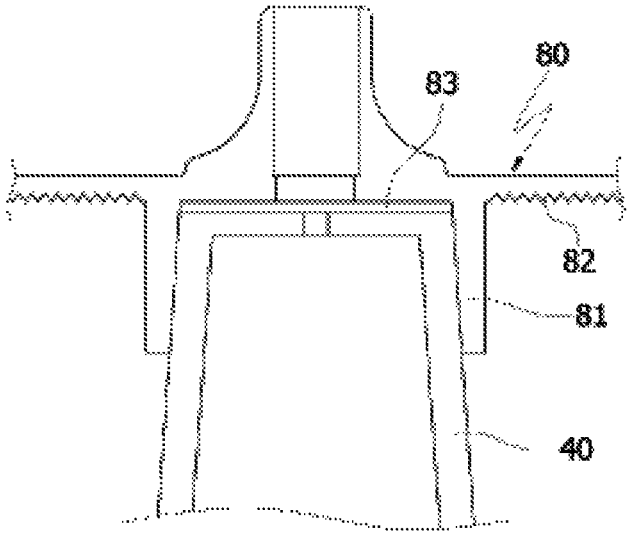
FIG. 4 is a cross-sectional view illustrating a configuration of an exemplary embodiment of a support unit and a coupling portion of a heat dissipation plate applied to the present disclosure.

FIG. 4 is a cross-sectional view illustrating the heat dissipation plate and the coupling portion of the support unit.

Referring to FIG. 4, heat dissipation fins 82 may be provided on the bottom surface of the heat dissipation plate 80 to increase a heat dissipation area so as to enhance heat dissipation efficiency. The coupling portion 81 provided at the central portion of the bottom surface of the heat dissipation plate 80 has an inclined side surface such that the inner diameter of the coupling portion 81 increases toward the outside.

As described above, the coupling portion 81 is formed in a shape that allows the coupling portion 81, which is made of a metal, to be readily fit on the support unit 40, which is also made of a metal. Although omitted from the drawings, a fastening means such as a bolt may be inserted through the side wall of the coupling portion 81 to fix the support unit 40.

In addition, a heat conducting sheet 83 is sandwiched between the top end of the support unit 40 and the top surface of the coupling portion 81. The heat conducting sheet 83 serves to prevent the formation of a gap between the support unit 40 and the coupling portion 81 so as to prevent a reduction in heat conductivity.

It has been illustrated and described that the heat dissipation fins 82 are provided on the bottom surface of the heat dissipation plate 80. However, the heat dissipation fins 82 may not be used and the bottom surface may be subjected to a mirror surface treatment to be used as a reflection plate.

The heat dissipation plate 80 reflects the light passing through the lampshade 70 after emitted from the LEDs of the upper substrate 20 downward again, which may provide a more beautiful illumination effect.

In addition, since the fins 82 formed on the heat dissipation plate 80 refract and diffract light, various illumination effects may also be created depending on the shape of the heat dissipation fins 82. The heat dissipation fins 82 may also be provided on the top surface of the heat dissipation plate 80.

As described above, according to the present disclosure, heat is dissipated through the side surface of the substrate support unit 30 that supports the lower substrate 10 and the upper substrate 20 and the heat is transferred and dissipated to the outside of the spherical cover configured by the upper cover 60 and the lower cover 50 through a heat dissipation path continued from the substrate support unit 30 to the support part unit 40 and the heat dissipation plate 80. As a result, the heat dissipation property may be further improved.

In the foregoing, although the present disclosure has been described in detail with reference to exemplary embodiments, the present disclosure is not limited to the exemplary embodiments and may be variously modified within the scope of the claims, the detailed description of the present disclosure and accompanying drawings. Such modifications belong to the scope of the present disclosure.

The present disclosure relates to a spherical lamp using LEDs which is configured to facilitate dissipation of heat emitted from the LEDs. As a result, the present disclosure may extend the lifespan of the spherical lamp and has industrial applicability.

The invention claimed is:

1. A spherical lamp facilitating heat dissipation, the spherical lamp comprising:

lower and upper substrates, on each of which a plurality of LEDs is mounted;

a plate-shaped substrate support unit having bottom and top surfaces, to which the lower and upper substrates are coupled, respectively;

lower and upper semi-spherical covers positioned on and fixed to the bottom and top surfaces of the plate-shaped substrate support unit, respectively;

a hollow support unit coupled to a central portion of the top surface of the plate-shaped substrate support unit that extends vertically upward through a central portion of the upper semi-spherical cover; and a heat dissipation plate positioned above the lower and upper semi-spherical covers having a coupling portion with a recess that extends vertically downward from a bottom surface thereof, wherein an end portion of the hollow support unit is disposed within and fixed to the recess of the coupling portion, and wherein a circumferential surface of the substrate support unit is exposed to the outside between the lower semi-spherical cover and the upper semi-spherical cover, the circumferential surface is disposed a plurality of heat dissipation fins.

2. The spherical lamp of claim 1, wherein the plate-shaped substrate support unit has a diameter larger than the diameters of the lower substrate and the upper substrates, the plate-shaped substrate support unit includes a plurality of coupling holes formed vertically therethrough to peripheral edges of the lower and upper semi-spherical covers, and a side surface of the plate-shaped substrate support unit is exposed to the outside between the lower and upper semi-spherical covers.

3. The spherical lamp of claim 2, wherein the exposed side surface of the plate-shaped substrate support unit is provided with the heat dissipation fins.

4. The spherical lamp of claim 1, wherein the plate-shaped substrate support unit, the hollow support unit, and the heat dissipation plate are all made of a metal.

5. The spherical lamp of claim 1, wherein an inner surface of the recess of the coupling portion abuts the end portion of the hollow support unit via a heat conducting sheet disposed therebetween.

6. The spherical lamp of claim 5, further comprising a lampshade fitted on the hollow support unit between the upper cover and the heat dissipation plate, wherein the lamp shape reflects or partially transmits light.

7. The spherical lamp of claim 6, wherein the heat dissipation plate has a disc shape and at least one surface of the heat dissipation plate is provided with the heat dissipation fins.

8. The spherical lamp of claim 1, wherein the upper semi-spherical cover includes a through hole disposed on the exterior surface through which the hollow support unit extends therethrough.

9. The spherical lamp of claim 1, wherein the plate-shaped substrate support unit and the hollow support unit are integrally formed.

10. The spherical lamp of claim 1, wherein the coupling portion disposed at the central portion of the bottom surface of the heat dissipation plate has an inclined side surface that increases the inner diameter of the coupling portion toward the outside.

11. The spherical lamp of claim 1, wherein the plate-shaped substrate support unit is configured to be electrically connected to the pendant via the hollow support unit, a through hole disposed in the coupling portion and the heat dissipation plate.

* * * * *